United States Patent [19]

Wang et al.

[11] Patent Number: 4,902,168

[45] Date of Patent: Feb. 20, 1990

[54] METHOD FOR REMOVING OBSOLETE OFFSHORE PLATFORMS

[75] Inventors: Frank S. Wang, Katy, Tex.; Charles T. Gautreau, Nine Mile Point; Robert W. Heels, Metairie, both of La.; Norman W. Hein, Jr., Katy, Tex.

[73] Assignee: Conoco Inc., Ponca City, Okla.

[21] Appl. No.: 249,633

[22] Filed: Sep. 26, 1988

[51] Int. Cl.[4] ..... E02D 9/04

[52] U.S. Cl. ..... 405/195; 166/55; 405/227; 405/232

[58] Field of Search ..... 405/195, 224, 227, 228, 405/231, 232; 29/426.4; 83/15, 16, 22; 166/55, 55.1, 55.2, 55.6, 55.7, 55.8, 297, 298, 302; 225/2, 93.5, 96, 96.5

[56] References Cited

U.S. PATENT DOCUMENTS

| | | | |
|---|---|---|---|
| 3,000,248 | 9/1961 | Boughton . | |
| 3,336,759 | 8/1967 | Copper . | |
| 3,507,425 | 4/1970 | Webb . | |
| 3,526,162 | 9/1970 | Willcox . | |
| 3,720,260 | 3/1973 | Duck et al. . | |
| 3,863,667 | 2/1975 | Ward . | |
| 3,878,978 | 4/1975 | Martinek . | |
| 3,979,981 | 9/1976 | Lightstone et al. . | |
| 4,112,795 | 9/1978 | de Putter . | |
| 4,447,952 | 5/1984 | Elkins . | |
| 4,487,643 | 12/1984 | Ellett . | |
| 4,619,556 | 10/1986 | Parra | 405/195 |
| 4,808,037 | 2/1989 | Wade et al. | 405/227 X |

OTHER PUBLICATIONS

"Offshore", Redden, Jim; Platform Removal Becomes International Issue, pp. 27–32, Nov. 1986.

"Offshore", Redden, Jim; Sea Turtle Kill Halts Use of Explosives, pp. 32, 35, Nov. 1986.

*Primary Examiner*—David H. Corbin

[57] ABSTRACT

A method for removing obsolete piling-anchored offshore platforms. The pilings at a desired cutoff point below the seabed are chilled to the point that toughness against brittle fracture is greatly reduced, and then a fracturing force is applied to the chilled section of piling.

3 Claims, 2 Drawing Sheets

METHOD FOR REMOVING OBSOLETE OFFSHORE PLATFORMS

BACKGROUND OF THE INVENTION

This invention relates to removal of offshore structures after the useful life of the structures in their original offshore location. More particularly, the invention is directed to a method of removing piling-anchored offshore platforms in an environmentally acceptable manner.

Many drilling and/or production platforms used in drilling for and/or producing oil and gas in shallow or moderately deep water are anchored to the seabed by large steel pilings which extend into the seabed and which support the platforms. Such platforms have a finite useful life, and after that are preferably removed to a new location or scrapped. In either event it is necessary to separate the platform from its anchoring pilings Environmental regulations require that pilings be cut at a specified depth, typically about 5 meters, below the seabed.

Various cutting techniques have been utilized, with varying degrees of success. The most common piling cutting technique uses explosives to sever the pilings at the required depth. Environmental and regulatory groups have objected to this technique as harmful to marine life.

Non-explosive cutters using mechanical cutters or abrasive fluid jets have been tried, but are costly and difficult to use, particularly in deeper waters.

SUMMARY OF THE INVENTION

In accordance with the present invention, an improved non-explosive process for cutting pilings is provided. This process involves chilling the piling at the desired cutting level to a temperature such that its toughness against brittle fracture is greatly reduced, and then applying a fracturing force to the chilled section of the piling to break it at the desired depth. The process can be applied to one or more or all of the pilings at a time, and the fracturing force can be applied in any of a variety of ways.

It is accordingly an object of the invention to provide an efficient, environmentally acceptable method for cutting platform-supporting pilings.

It is a further object to provide such a method which involves chilling the piling to a temperature low enough to greatly reduce the piling's toughness against brittle fracture, and applying a fracturing force to the piling.

The foregoing as well as additional objects and advantages are achieved by the invention as will be apparent from consideration of the following detailed description thereof.

THE DRAWINGS

DESCRIPTION OF THE PREFERRED EMBODIMENT

The process of the invention will be described with reference to the several views of the drawings.

Figure 1:
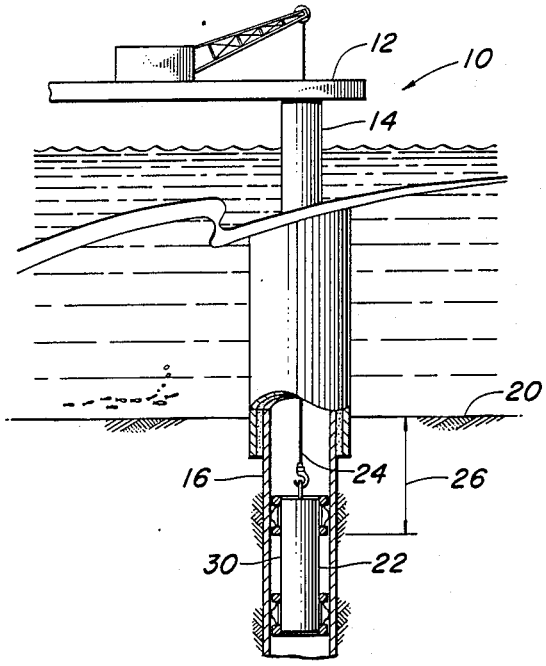
FIG. 1 is a side elevational view, partially cut away and partially reduced in scale, illustrating the environment where the invention is to be utilized.
Figure 3:
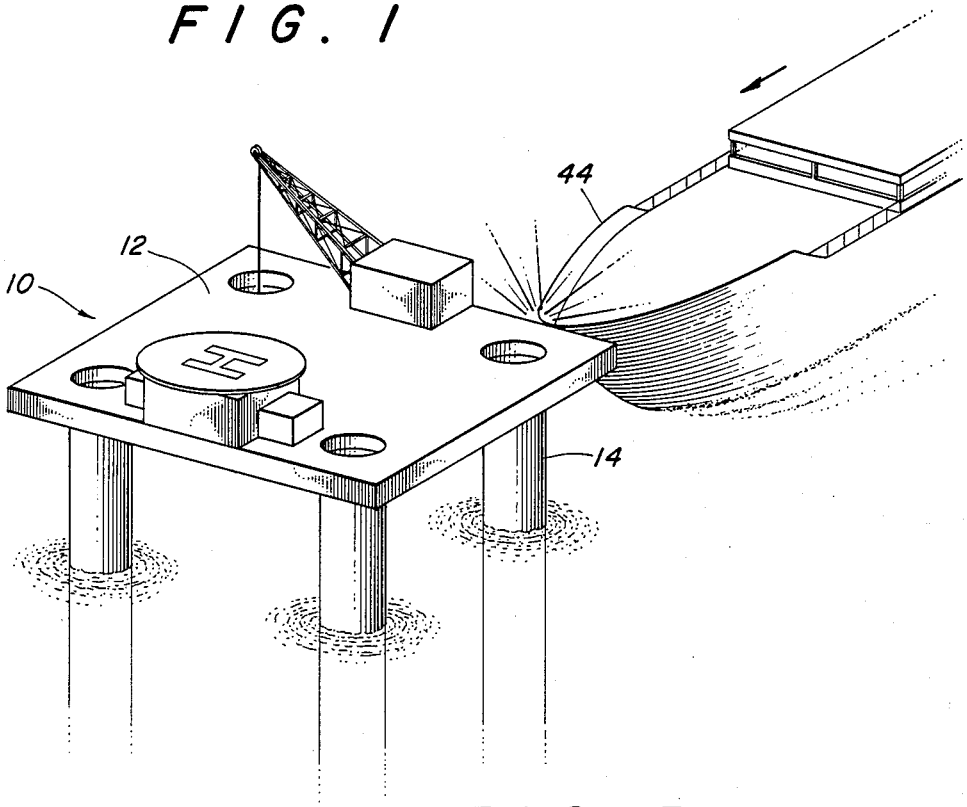
FIG. 3 is a perspective view illustrating an embodiment of applying a pile fracturing force to an offshore structure.

FIGS. 1 and 3 show a platform 10 which is to be removed because drilling and/or production from the platform is no longer to be carried out. As shown, the platform has already been stripped of most of its drilling and/or processing equipment, and is to be removed to eliminate it as a potential hazard to navigation. It will be appreciated that FIGS. 1 and 3 do not show structural details of the platform which are not relevant to the invention. Platform 10 includes a deck 12 supported by legs or jackets 14.

Figure 2:
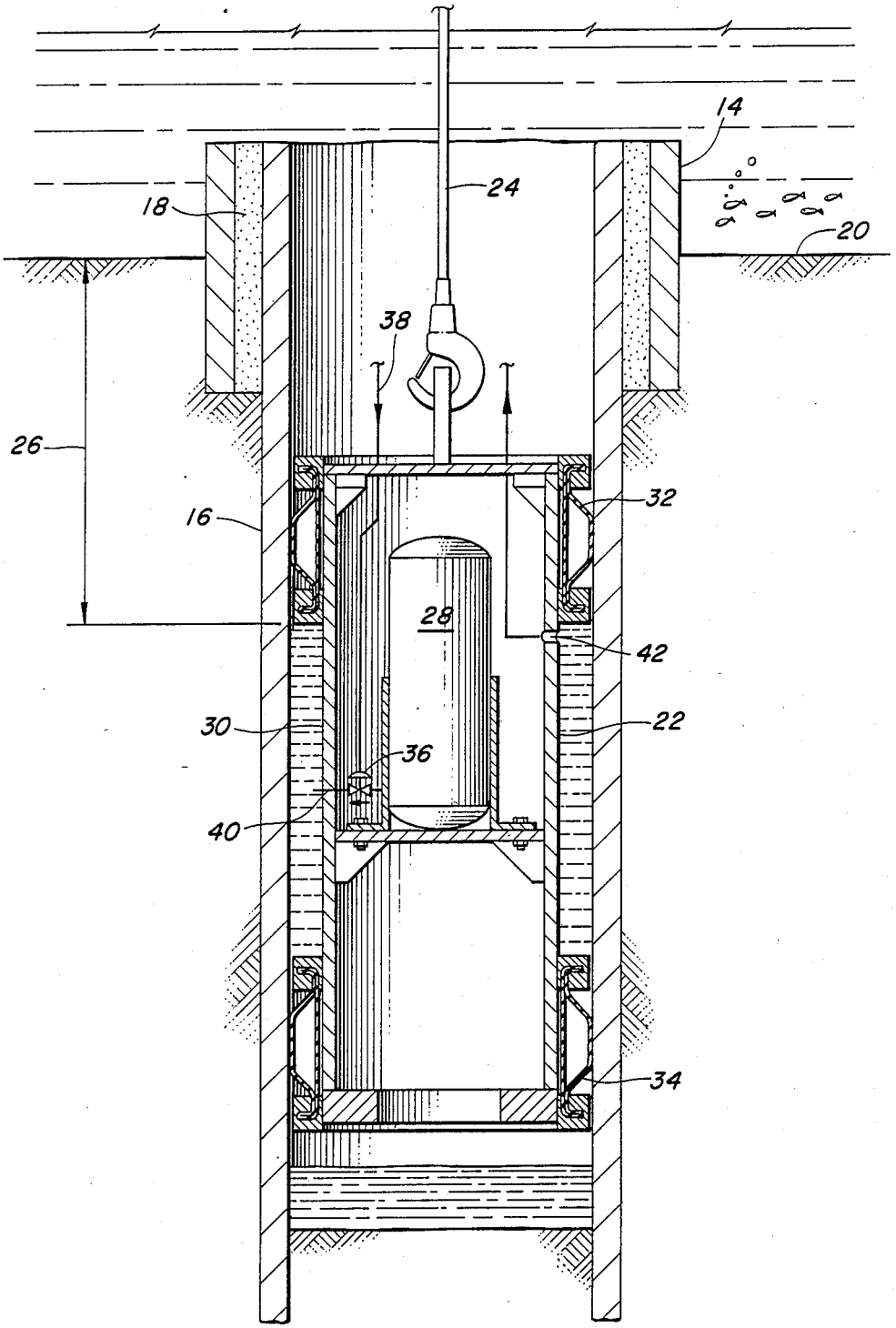
FIG. 2 is a cross sectional view showing details of an apparatus for chilling a piling at a desired depth.

As best seen in FIGS. 1 and 2, each leg 14 is supported on a piling 16 by conventional structure (not shown) and further supported by grouting 18 between piling 16 and leg 14.

In installing platform 10, pilings 16 are driven a predetermined depth into the sea floor 20, and platform legs or jackets 14 are then installed over and supported by the pilings to provide a solid foundation for the platform.

When it is desired to remove the obsolete platform 10, in accordance with this invention a self-contained piling chilling device 22 is lowered by cable 24 or other suitable means through leg 14 and piling 16 to a depth sufficiently below the sea floor that the resulting piling fracture will be at least as deep as the required depth illustrated by the arrows as noted at 26 in FIGS. 1 and 2.

Piling chiller 22, as seen in FIG. 2, includes a tank 28 supported within cylindrical member 30. Seals 32 and 34 are located at the top and bottom of cylinder 30 to seal off an annulus between cylindrical member 30 and piling 16. In some cases only a top seal is needed. The seals may be hydraulically or pheumatically operated, or may be formed of oversized compressible material. A control valve 36 operated remotely through control line 38 controls discharge of cooling fluid from tank 28 through conduit 40 into the annulus between cylindrical member 30 and piling 16. A vent 42 in cylindrical member 30 allows cooling gas to be discharged from the annulus into the open space in piling 16.

It will be appreciated that piling chiller 22 could be varied in many respects from the version shown in FIG. 2, which is merely illustrative of an suitable device for chilling the piling 16.

In carrying out the process of the invention, preferably after platform 10 has been stripped of most or all of the heavy drilling, processing or other equipment, a piling chiller is lowered into one or some or all of the pilings 16 to a depth below the required removal point. In some cases, water or mud may have to be removed from the interior of the piling, and structural obstacles on the platform or in the jacket or piling may have to be removed. After access is provided, piling chiller 22 is lowered and sealed in position, and a cryogenic fluid from tank 28 is discharged into the annulus to chill the adjacent section of piling to a point where its toughness against brittle fracture is greatly reduced. Any cryogenic fluid may be used, but liquid nitrogen is normally the fluid of choice for reasons of cost and availability.

After the piling (or pilings) has been sufficiently chilled, a fracturing force is applied to fracture the piling and release the leg or platform from the sea floor. Obviously, care must be taken to prevent sudden vertical movement or overturning of the platform. The fracturing force can be applied in any manner, such as by impact or by suddenly applied tension. FIG. 3 illustrates a preferred impacting technique in which the platform is simply rammed by a large ship 42. In actual practice, a bumper type structure on both the platform and the ship would be used to protect the ship and to properly distribute the fracturing force. Alternatively, a sudden application or release of tension by manipulation of cables, or use of large hydraulic rams, could be used to apply the necessary fracturing force.

In some instances, it may be desirable to carry out a fracture initiating step to the chilled section of piling prior to application of the fracturing force. This fracture initiating step may comprise scoring the chilled section of piling, or applying a localized blow to the chilled section.

Variations of the above-described embodiments will be apparent to those skilled in the art, and are intended to be included within the scope of the invention as defined by the appended claims.

We claim:

1. A method for removing an offshore platform anchored to the seabed by hollow pilings comprising:

(a) establishing an annulus inside one of said pilings at a level below the top of said seabed by lowering a cylindrical member down into said piling and sealing at least the top of said member against the interior of said piling, the interior surface of said piling defining the outer circumference of said annulus, (b) injecting a chilling agent into said annulus in an amount sufficient to reduce the toughness of said piling against brittle fracture; and (c) applying a force to said piling to fracture said piling adjacent said annulus.

2. The method of claim 1 wherein said cylindrical member is sealed against the interior of said piling at the top and bottom of said cylindrical member.

3. The method of claim 1 wherein said applied force is an impact force applied by ramming said platform with a vessel.

* * * * *